United States Patent [19]

Pacinelli

[11] Patent Number: 4,488,442

[45] Date of Patent: Dec. 18, 1984

[54] COMPENSATING TORQUE WRENCH

[76] Inventor: Louis A. Pacinelli, 6522 Haverford Ave., Philadelphia, Pa. 19151

[21] Appl. No.: 500,060

[22] Filed: Jun. 1, 1983

[51] Int. Cl.[3] ..... B25B 23/142

[52] U.S. Cl. ..... 73/862.21; 81/55

[58] Field of Search ..... 73/862.21, 862.26; 29/240; 81/53 R, 13, 56, 55, 436, 437, 472

[56] References Cited

U.S. PATENT DOCUMENTS

| | | | |
|---|---|---|---|
| 2,599,489 | 6/1952 | Schmidt | 81/437 X |
| 2,736,220 | 2/1956 | Kamuk | 81/55 |
| 3,175,433 | 3/1965 | Akers, Jr. | 81/56 X |
| 3,394,623 | 7/1968 | Kinakin | 81/55 |
| 4,165,660 | 8/1979 | Behrens | 81/55 |

*Primary Examiner*—Charles A. Ruehl

*Attorney, Agent, or Firm*—Caesar, Rivise, Bernstein & Cohen, Ltd.

[57] ABSTRACT

A compensating torque wrench device used for tightening an internally threaded member (e.g., a nut) to an externally threaded member (e.g., a bolt). The internally threaded member is of conventional construction while the externally threaded member includes a free end having a recess. The device includes a working end having first engagement means which engages the internally threaded member and second engagement means comprising a rotatable projection for engaging the recess of the externally threaded member. The device also includes first and second rotational means and a driven end (e.g., a handle), such that the driven end is connected to the first engagement means by the first rotational means and to the second engagement means by the second rotational means. When force is applied to the handle, the first rotational means exerts a first torque on the first engagement means causing it to rotate in the first rotational direction and causes the second rotational means to exert a second torque on the second engagement means, causing it to rotate in the opposite rotational direction. The device also includes torque measuring means which indicates the amount of torque being applied to the nut and bolt, respectively.

24 Claims, 8 Drawing Figures

COMPENSATING TORQUE WRENCH

BACKGROUND OF THE INVENTION

This invention relates generally to tools, and more particularly, to torque wrenches.

As is well known in the art, when an internally threaded member (e.g., a nut) is tightened onto an externally threaded member (e.g., a bolt), the bolt tends to undergo a substantial amount of twist (e.g., stress) adjacent its interface with the nut. This stress may at times be great enough to cause the bolt to fracture or otherwise become damaged therealong.

The instant invention involves a compensating torque wrench tool which is arranged to substantially reduce this stress during the tightening process by rotating the nut in a first rotational direction, while at the same time rotating the associated bolt in the opposite rotational direction. The device further includes means for measuring and indicating the amount of torque being applied to the nut and bolt, respectively.

In the prior art various types of torque wrenches have been disclosed. Some of such wrenches, include bolt tensioning means and/or torque measuring means.

One such device is disclosed in the U.S. Pat. No. 2,760,393 (Stough). The Stough device is used for pretensioning a bolt and tightening a nut thereon. A first portion of the device engages the free end of the bolt so as to produce a predetermined amount of axial tension on the bolt, without applying any torque or twisting action to the bolt. A second portion of the device rotates the nut onto the bolt while the bolt is being pretensioned as just described. The device further includes tension indicator means to measure the amount of axial tension being applied to the bolt.

Another prior art device, this one designed to simultaneously rotate a bolt in a first rotational direction and a nut in the opposite rotational direction is manufactured and sold by Ingersoll-Rand Corporation, is illustrated in a sales brochure published by Bethlehem Steel Corporation, of Lebanon, Pennsylvania. The device is used in combination with a specially constructed bolt which is manufactured and sold by Bethlehem Steel. In that regard, a 12-point spline (i.e., a gear-like member) is frangibly secured, axially to the free end of the bolt. In order to tighten the nut to the bolt, the torque wrench engages and rotates the nut in a clockwise direction while at the same time engaging the spline with a socket-like member and rotating it, together with the bolt, in the opposite direction, until the torque is sufficiently great to cause the spline to fracture free from the bolt.

The Ingersoll-Rand device does not include force measuring means, nor does it include means for tightening the nut to the bolt at a tension other than the tension causing the spline to fracture free from the bolt.

Furthermore, the device requires the use of a rather intricately constructed and probably expensive bolt, whose frangible spline would preclude the bolt from being re-used.

Various other types of torque wrenches, some of which include force measuring means, are disclosed in the following U.S. Pat. Nos. 2,888,825 (Krafft); 3,643,501 (Pauley); 4,212,196 (Krieger); 4,226,127 (Hardiman) and 4,274,310 (Michaud). However, it should be pointed out that none of the above identified patents disclose a torque wrench capable of rotating the bolt in a rotational direction opposite to that of the nut.

OBJECTS OF THE INVENTION

Accordingly, it is a general object of the invention to provide a torque wrench device which overcomes the disadvantages of the prior art.

It is another object of the invention to provide a torque wrench capable of applying a torque to a nut in a first rotational direction, while at the same time applying a counter-rotational torque (e.g., a torque in the opposite rotational direction) to the associated bolt, thus minimizing the amount of stress on the bolt adjacent its interface with the nut.

It is a further object of the invention to provide a torque wrench which tightens a nut to a bolt by applying a torque to the nut in a first rotational direction and a counter-rotational torque to the bolt in the opposite direction, and further includes torque measuring means which indicates the amount of torque being applied in both the rotational and the counter-rotational directions, respectively.

It is still a further object of the instant invention to provide a compensating torque wrench which includes a rod-like projection for engaging a corresponding notch in the free end of a bolt to rotate the bolt in a predetermined rotational direction, while at the same time rotating its associated nut in the opposite rotational direction.

It is still a further object of the invention to provide a compensating torque wrench which is durable, relatively simple in construction and may readily be used for either tightening or loosening a nut from a bolt.

SUMMARY OF THE INVENTION

These and other objects of the instant invention are achieved by providing a compensating torque wrench device which is used for tightening or loosening an internally threaded member on an externally threaded member in a manner which reduces the amount of stress on the members adjacent their interface. The internally threaded member is of conventional construction, while the externally threaded member has a free end which includes third engagement means for engaging the device. The device includes a working end having first engagement means for engaging the internally threaded member and second engagement means in the form of a rotatable projection for engaging the third engagement means of the externally threaded member. The device also includes first and second rotational means and a driven end. The driven end is connected to the first engagement means by the first rotational means and to the second engagement means by the second rotational means. Force applied to the driven end causes the first rotational means to exert a first predetermined amount of torque on the first engagement means, causing the first engagement means along with the internally threaded member to rotate in a first rotational direction. This force also causes the second rotational means to exert a second predetermined amount of torque on the second engagement means, causing the second engagement means along with the externally threaded member to rotate in the opposite rotational direction. The device further includes torque measuring means to indicate the amount of torque being applied to one of said members.

DESCRIPTION OF THE DRAWING

Other objects and many of the attendant advantages of the invention are readily appreciated as the same becomes better understood by reference to the following detailed description when considered in connection with the accompanying drawing wherein:

FIG. 2 is a top plan view of the device of FIG. 1, with the phantom lines showing a portion of the device in a rotated position;

FIG. 8 is an enlarged side elevational view, partially in section, of a socket extension used in combination with the device of FIG. 1.

DETAILED DESCRIPTION OF THE PREFERRED EMBODIMENT

Figure 1:
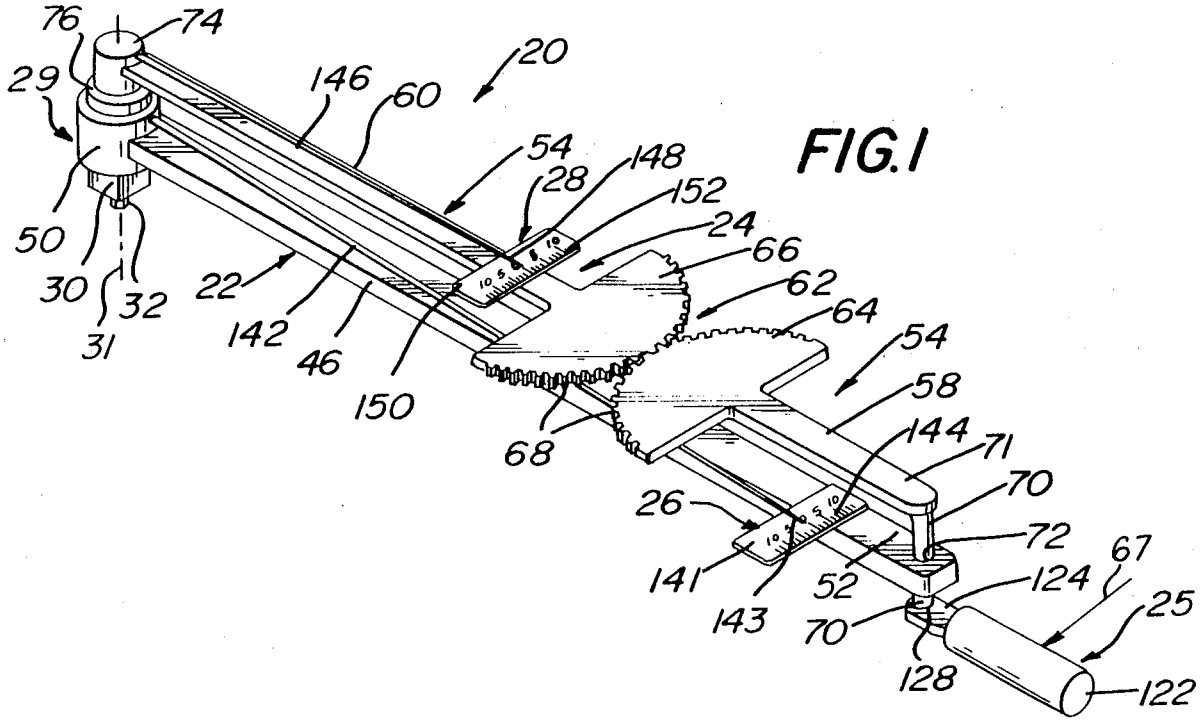
FIG. 1 is a perspective view of a compensating torque wrench device constructed in accordance with this invention.

Referring now to the various figures of the drawing wherein like reference characters refer to like parts, there is shown at 20 in FIG. 1 a compensating torque wrench device constructed in accordance with the instant invention.

The device 20 as shown herein, is primarily designed to tighten an internally threaded member (e.g., a nut) to an externally threaded member (e.g., a bolt) by applying a torque in a first rotational direction to the nut, causing it to rotate in a first rotational direction, while at the same time applying a torque in a second or opposite rotational direction to the bolt, causing it to rotate in the opposite rotational direction.

As a result of the counter-rotational torque applied to the bolt during the tightening process, undue stress on the bolt is avoided, thus substantially reducing the likelihood of the bolt fracturing adjacent its interface with the nut.

It should further be mentioned that the device 20 can also be used to loosen or remove a nut from a bolt, although the primary advantages of the instant invention over the prior art are best realized during the tightening process. Accordingly, although much of the description of the device 20 which follows relates to its mode of operation for tightening a nut to a bolt, the description is also generally applicable with regard to its mode of operation for the loosening process as well. The desired selection of the mode of operation is made by reversing the operational direction of ratcheting means as shall be described later.

As shown in FIG. 1, the device 20 basically comprises rotational means 22, counter-rotational means 24, handle means 25, first and second torque measuring means 26 and 28, respectively, and a working end 29 which includes both nut engagement means 30 and bolt engagement means 32. In order to tighten a nut to a bolt, the nut is engaged by the nut engagement means 30 while the threaded or free end of the bolt is engaged by the bolt engagement means 32. The person using the device 20 then manually rotates the handle means 25 in a clockwise direction. This action results in the rotational means 22 causing the nut engagement means to rotate the nut in a clockwise direction. Moreover the clockwise rotation of the handle results in the counter-rotational means 24 causing the bolt engagement means to rotate the bolt in a counter-clockwise direction. The amount of torque being applied to the nut is measured and indicated by the first (e.g., rotational) torque measuring means 26, while the amount of counter-rotational torque being applied to the bolt is measured and indicated by the second (e.g., counter-rotational) torque measuring means 28.

It should be pointed out at this juncture that the relative amount of counter-rotational torque applied to the bolt as compared to the amount of rotational torque applied to the nut may readily be adjusted as desired and as shall be described later.

Figures 3, 4, 5, 6, 7:
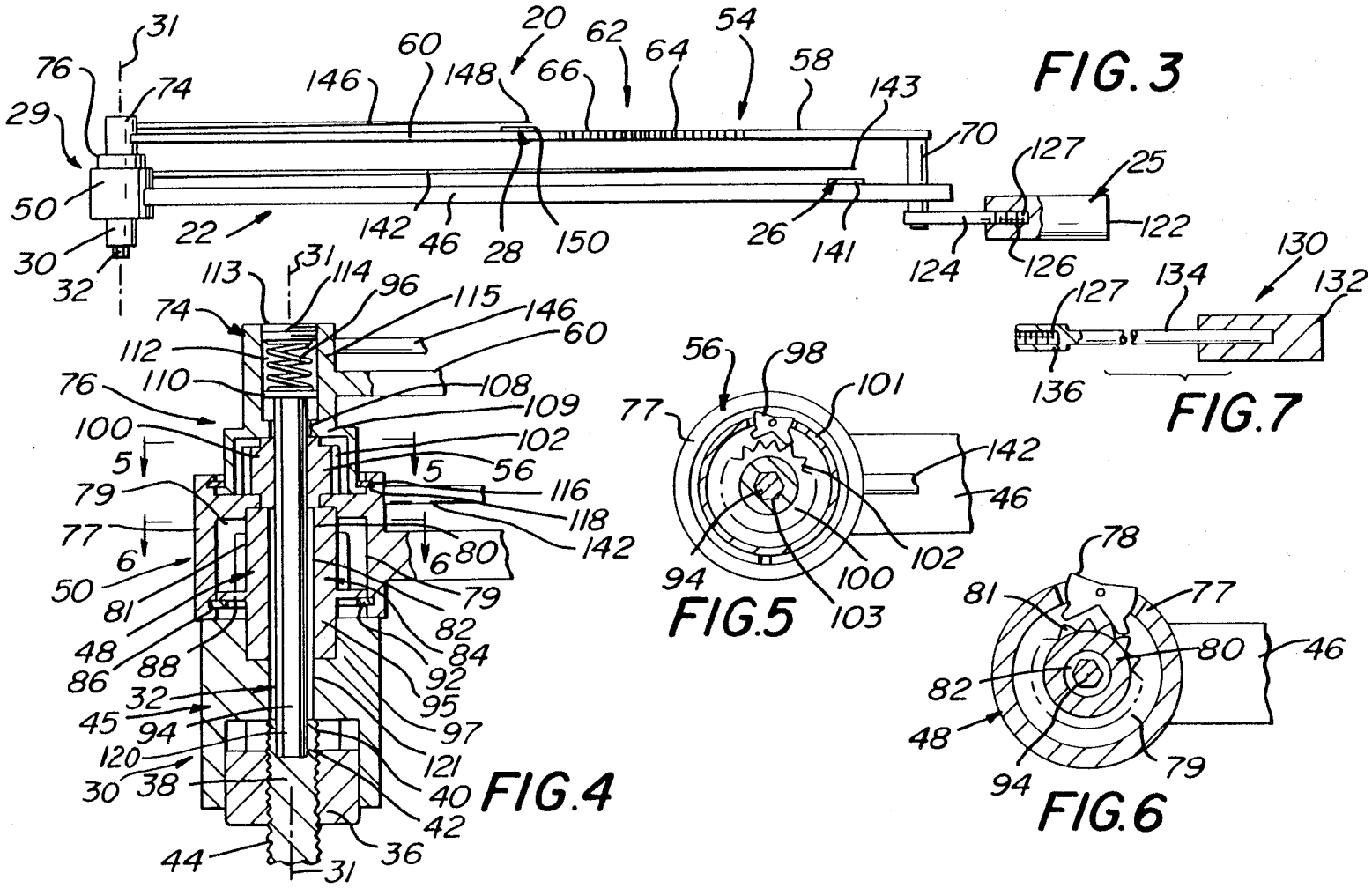
FIG. 3 is a side elevational view, partially in section, of the device of FIG. 1.
FIG. 4 is an enlarged sectional view taken along line 4—4 of FIG. 2, showing the device of FIG. 1 connected to an interchangeable socket and engaging both a nut and a bolt in accordance with the teachings of this invention (the bolt being only partially shown)
FIG. 5 is a sectional view taken along line 5—5 of FIG. 4.
FIG. 6 is a sectional view taken along line 6—6 of FIG. 4.
FIG. 7 is a perspective view, partially in section and partially broken away, of an extension handle used with the torque wrench of FIG. 1.

Referring to FIG. 4, the nut engagement means 30 is shown gripping a nut 36 while the bolt engagement means 32 is shown engaged to a specially constructed bolt 38, which shall be described next.

The bolt 38 (only a portion of which is shown in the drawing) includes a free end 40 having a hexagonally-shaped notch or recess 42 extending a short distance, e.g., 1 cm, axially therein. The notch 42 serves as means by which the bolt is engaged by the bolt engagement means 32 during the tightening or loosening process, as shall be described in greater detail later. The threads 44 and the head portion (not shown) of the bolt are both of conventional construction.

The nut 36 is of conventional construction and includes a bore and helical threads of appropriate size and construction to matingly engage the external threads 44 of the bolt in the typical fashion.

Obviously, the device can be modified for use with other types of internally threaded members and mating externally threaded members as well.

The nut engagement means 30 includes a conventional twelve (12) point socket 45 which is readily interchangeable with other sockets of differing sizes so that the device may be used for tightening or loosening nuts of a variety of different sizes.

The rotational means 22 basically comprises an elongated arm 46 (FIG. 3) and associated ratcheting means 48 (FIG. 6) located in working end 29. The arm 46 is radially coupled to the ratcheting means 48 to enable the ratcheting means 48 to rotate in the same rotational direction as the arm 46 when the arm is rotated by a force manually applied to the handle means 25. The ratcheting means 48 is also coupled to the nut engagement means 30, as will be described later.

Suffice it to state for now that the ratcheting means 48 causes the nut engagement means 30 to rotate in a first rotational direction about the central axis 31 of the working end 29 when the arm 46 is rotated in that rotational direction while allowing the nut engagement means to remain generally stationary when the arm is rotated in the opposite rotational direction. The direction of rotation is readily established by changing the position of an adjustable pawl or thumb latch, to be described later.

As can be seen clearly in FIGS. 1 and 3 the elongated arm 46 is a solid, generally rectangular bar which is integrally formed from a portion of the working end 29, namely, its lower annular shell 50. Although the arm 46 is generally rigid, it nonetheless exhibits a certain amount of flexibility to enable it to temporarily deform, at least slightly, when a force is applied to its handle end 52. This feature enables the amount of force being applied to the nut 36 to be measured and indicated by the rotational torque measuring means 26, as shall be described later.

The counter-rotational means 24 (FIG. 1) basically comprises an articulated arm 54 which is radially coupled to ratcheting means 56 (FIG. 5), with the latter forming a portion of the working end 29. As a result of this coupling, rotational movement of the arm 54 produces corresponding rotational movement of both the ratcheting means 56 and the bolt engagement means 32 to which it is connected, when the pawl or thumb latch of the ratcheting means (to be described later) is appropriately positioned.

As can be seen in FIGS. 1 and 3 the counter-rotational arm 54 includes a primary stem 58, a secondary stem 60 and connecting joint means 62. The connecting joint means 62 comprises a primary gear 64 and a secondary gear 66. The primary gear 64 is integrally formed with the primary stem 58 while the secondary gear 66 is integrally formed with the secondary stem 60. Both the primary gear 64 and the secondary gear 66 are semi-circular and include teeth 68 along their respective semi-circular edges, which teeth 66 are co-planar so that the primary and secondary gears mate or engage with each other.

As a result, when the handle means 25 is in a centered or null position (e.g., as shown in FIG. 1) the primary stem and secondary stem are situated along a single axis, parallel to the longitudinal axis of the handle means.

The primary stem 58 is a generally rod-like elongated member which includes at its free end 71 a downwardly projecting pivot rod 70. The rod 70 extends through a bore 72 in the rotational arm 46 and is fixedly secured, e.g., welded, to the handle means 25. The longitudinal axis of the rod 70 is at right angles to the longitudinal axes of both the primary stem 58 and the handle means 25. Moreover, the rod 70 is fixedly secured, e.g., welded, to the primary stem 58. Thus, the rod is precluded from rotating independently of either the primary stem or the handle means, yet can rotate within the bore 72.

As a result of the foregoing arrangement, when a force is applied at right angles to the handle means 25, e.g., in the direction of the arrow 67 shown in FIG. 1, it not only causes the rotational arm 46 to rotate about the central axis of the working end 29, but also causes the handle 25 to pivot and the rod 70 to rotate within the bore 72. This in turn causes the primary stem and primary gear to rotate in a first rotational direction (e.g., in a clockwise direction) about the rod's central axis as shown by the phantom lines at 73 in FIG. 2.

Furthermore, the mating arrangement between the primary and secondary gears 64 and 66, respectively, results in the secondary gear 66 (and hence its stem 60) rotating in the opposite rotational direction (e.g., counter-clockwise) about its pivot axis as shown by the phantom lines at 75.

Inasmuch as the pivot axis of the secondary gear and stem is the central axis of the working end 29, it can readily be appreciated that when a force is applied to the handle means in a generally clockwise direction, the rotational arm 46 rotates in a clockwise direction about the central axis 31 of the working end 29 and the secondary stem 60 of the counter-rotational means moves in a counter-clockwise direction about that same axis.

As shall be described next, the working end 29 of the device includes first means for utilizing one (e.g., the clockwise) rotational movement of the arm 46 to produce clockwise rotational movement of the nut engagement means 30 about axis 31 and second means for utilizing the (e.g., counter-clockwise) rotational movement of the counter-rotational arm 54 to produce counter-clockwise rotational movement of the bolt engagement means 32 about axis 31.

The working end 29 (FIG. 1) of the device is generally enclosed within a hollow upper shell 74, a hollow intermediate shell 76 and a hollow lower shell 50. The three shells 74, 76 and 50, respectively, are concentric with one another, with the upper shell 74 being situated above and integrally formed with the intermediate shell 76. The lower shell 50 is situated contiguous with and generally below, the intermediate shell and is able to rotate independently therefrom.

Referring to FIG. 3, the working end 29 is arranged such that the upper shell 74 is of smallest diameter and integrally formed with not only the intermediate shell but also with the secondary stem 60. The lower shell 50 is of greatest diameter and as mentioned before, is formed integral with the rotational arm 46.

Concentrically positioned within the interior of the lower shell 50 is the ratcheting means 48 (FIGS. 4 and 6). The ratcheting means 48 (FIG. 6) is of generally conventional construction and includes a pawl 78 (e.g., a thumb latch) and a hub 80. The pawl enables one to manually select the operational direction of the ratcheting means 48. The pawl 78 is pivotably mounted onto the cylindrical sidewall 77 of the lower shell 50 and includes an exterior portion which extends through a slot (not shown) to the exterior of the shell as shown in FIG. 2.

The hub 80 (FIG. 4) is a generally circular member centrally located within the interior lower shell 50 to form an annular recess 79 between its outer periphery and the inner surface of cylindrical wall 77 of the lower shell. The hub 80 includes plural teeth 81 projecting radially outward from its outer periphery and aligned with the pawl 78. By pressing on the exteriorly extending portion of the pawl in a conventional manner, the pawl is positioned to engage the teeth 81 of the hub 80, as shown in FIG. 6, causing the hub to rotate about its central axis 31 in the same direction as the direction of rotation of the lower shell 50.

As will be appreciated by those skilled in the art, the ratcheting means enables the hub to be rotated through a large angle of degrees in either rotational direction as desired, without requiring the arm 46 to be rotated more than a few degrees in that direction at a given time. This feature is particularly important since the connecting means 62 of the counter-rotational arm inherently limits the counter-rotational movement of the arm 54 to a maximum of approximately 90° in any one direction before the respective gears 64 and 66 disengage from each other.

As can be seen in FIG. 4 the lower shell 50 includes an annular groove 86 extending about its hollow interior adjacent its lower end. A retaining ring 92 is located within the groove 86 and serves to hold the ratcheting means 48 at its proper location within the lower shell 50. To that end, the hub 80 of the ratcheting means includes an annular flange 88 which is disposed upon the retaining ring 92. The hub 80 futher includes a central cylindrical bore 82. A hexagonal rod 94, which forms a portion of the bolt engagement means 32, extends through the cylindrical bore 82 so as to be free of physical contact with the hub 80. The rod 94 is thus free to slide and/or rotate independently of the hub, as shall be described later.

The bottom end of the hub 80 is in the form of a shank 84 extending downwardly for releasably mounting a conventional socket thereon. Thus the free end 95 of the shank is square for receipt within a matingly shaped mounting recess in a conventional socket 45.

The shank 84 and socket 45, together comprise the heretofore mentioned nut engagement means 30.

As should be appreciated from the foregoing, rotational movement of the hub and shank 80 and 84, respectively, causes the socket 45 to rotate in the same direction. This in turn causes the nut 36 engaged thereby to also rotate in that direction.

In addition to the arm 54, the heretofore identified counter-rotational means 24 comprises other ratcheting means 56 (FIG. 5), the heretofore identified elongated hexagonal rod 94 (e.g., the stem of an allen wrench) and a compression spring 96, all located within the working end 29, of the device.

Referring to FIG. 4, as can be seen the other ratcheting means 56 is located within the intermediate shell 76 and the spring 96 is located within the upper shell 74. The rod 94 extends from the upper shell, through the intermediate shell 76 and then through and out the lower shell 50.

The ratcheting means 56 is similar to ratcheting means 48 described heretofore, and basically comprises a pawl 98 and an annularly shaped hub 100. The pawl 98 is pivotably connected to the circular wall 101 of the intermediate shell 76 in the same manner as the manner in which the pawl 78 is connected to the wall 77 of the lower annular shell 50. The hub 100 is an annularly shaped member comprising plural teeth 102 extending around its periphery, which are situated so as to releasably engage the pawl 98, in the same mannner as described with regard to the pawl 78. Obviously, the direction of rotation which results in rotational movement of the hub 100 is determined by the position of the pawl 98. In this regard, in order for the device 20 to operate as intended, the pawls 78 and 98 are respectively positioned to permit rotational movement in opposite directions. In order to tighten a conventional nut to a bolt, the pawl 78 is positioned to permit clockwise rotation while pawl 98 is positioned to permit counter-clockwise rotation, and to loosen the nut from the bolt, the positioning is just the reverse.

As can be seen in FIG. 4 a retaining ring 116 secures the ratcheting means 56 in place within the shell 76 and holds the intermediate and lower shells together. In this regard, the ring 116 is located in an annular recess 118 in the upper portion of the lower shell 77 and overlies the lower flanged lip of the intermediate shell.

The hub 100 of the ratcheting means 56 also includes an opening 103 passing axially through its center. The opening 103 is hexagonally shaped and of appropriate size so as to conform to the cross-sectional dimensions of the rod 94. The rod 94 extends through the opening 103, with its longitudinal sides being contiguous to (or at least closely adjacent) the walls defining the opening 103. As a result of this arrangement, the rod 94 is able to slide longitudinally within the opening 103, but is precluded from rotating independently of the hub 100. In other words, the rod 94 rotates along with the hub whenever the hub rotates, and conversely, does not rotate whenever the hub is stationary.

The upper portion 106 of the rod 94 passes through a circular central opening 108 in the bottom wall 109 of the upper shell 74. The rod 94 is free of contact with the wall 109 so as to be able to freely rotate independently of the rotational movement of the upper shell 74.

The top end of the rod 94 is in the form of an enlarged circular disk or head 110. The head 110 is located within a cylindrical cavity 112 within the upper shell 112. The cavity 112 is bounded by the walls of the upper shell 74 and includes a threaded open top end 113. Also located within the upper shell 74 is the compression spring 96 and a set screw 114. The set screw 114 is threadily engaged in opening 113 to interpose the compression spring between it and the rod's head 110. Consequently, the spring applies a downward force against the head of the rod 94 causing the rod to be biased in a downward direction. The amount of force provided by the spring is readily adjusted by rotating the set screw 114 in the appropriate direction.

The lower portion 120 of the rod 94 extends through a hollow central opening 121 in the socket 45, free of contact with the socket and therefore, freely rotatable with respect to the socket. Not only can the rod freely rotate within the central opening 121 of the socket 45, but it can also move longitudinally along the central axis 31 of the socket either upwardly or downwardly, depending upon the biasing force of the spring relative to the external forces (e.g., from the movement of the bolt 38) tending to move the rod in an upward direction.

Although in the preferred embodiment, the free end 120 of the hexagonal rod 94 is designed to fit within a hexagonal notch or recess 42 in the free end of the bolt 38, it should be appreciated that the rod need not be hexagonal, but may be square, rectangular or of other cross-sectional construction so long as it is used in combination with a bolt having a correspondingly shaped recess.

Moreover, the compression spring 96 insures that the free end 120 of the rod 94 remains securely positioned within the notch 42 as the bolt moves longitudinally relative to the nut 36, during either the tightening or loosening process. More specifically, as the nut is tightened onto the bolt, the rod 94 is pushed upwardly causing the spring 96 to compress and when the nut is loosened from the bolt, the biasing force of the spring tends to push the rod 94 downwardly to maintain its presence within the notch 42.

It should now readily be appreciated that rotational movement of the secondary stem 60 of the counter-rotational means causes the upper shell 74 and intermediate shell 76 to rotate in the same rotational direction as that of the stem. Since the hub 100 is coupled to the outer shell 76 by the pawl 98 of the ratcheting means 56, rotational movement of the shell 76 is not only independent of the rotational movement of the lower shell 50, but also results in either corresponding rotational movement of the hub 100 or alternatively, no rotational movement of the hub, depending upon which way the pawl 98 is positioned.

As a result of the foregoing discussion, it should further be appreciated that when the free end 120 of the rod 94 engages the corresponding axial notch 42 in the bolt 38, the counter-rotational torque and movement of the rod rotates the bolt, independently of the rotational force being applied to the nut 36 by the socket 45, thus causing the nut and bolt to rotate simultaneously in opposite directions.

As can be seen in FIGS. 1 and 3 the handle means 25 comprises a cylindrical hand grip mounted on a threaded stem 124. The stem 124 is in the form of a generally rectangular bar which tapers to a cylindrically shaped, threaded end portion 127. The end portion 127 threadily engages an internally threaded bore 126 which is axially located in the hand grip. The rectangular portion of the stem 124 includes a bore 128 (FIG. 1) of appropriate size to receive a portion of the pivot rod 70. In that regard, the pivot rod extends into the bore 128 and is welded in place thereat so as to prevent the stem 124 from rotating with respect to the pivot rod 70, as mentioned earlier.

Since the pivot rod 70 acts as a fulcrum for the rotation of the primary stem 58 of the counter-rotational means, the amount of counter-rotational torque produced relative to the amount of rotational torque produced, is varied by increasing or decreasing the length of the handle means (e.g., the distance the gripping end 122 is located from the pivot rod).

This is readily achieved by means of unthreading and removing the gripping end 122 of the handle 25 (FIG. 3) and replacing it with an extension handle 130, such as the one shown in FIG. 7. The extension handle 130 includes a hand grip 132, an elongated stem 134 and a connecting portion 136. The hand grip 132 is essentially the same as the hand grip 122, except that grip 132 is permanently secured to its elongated stem 134. The elongated stem 134 is a cylindrical rod which is connected at one end to the grip 132. Its opposite end is in the form of an internally threaded female connector 136. The female connector 136 threadedly engages the threaded end 127 of stem 126, thus connecting the extension handle 130 to the device 20.

Inasmuch as the extension handle 130 is readily interchangeable with other handle means (not shown) whose respective stems are of differing lengths, the ratio of counter-rotational torque to rotational torque can be readily adjusted by substituting appropriately sized handle extensions, as desired.

It should further be pointed out that the amount of counter-rotational torque produced relative to the amount of rotational torque produced may also be changed by changing the length of the primary stem 58, relative to the length of the secondary stem 60.

In the preferred embodiment of the device shown herein, the primary stem 58 is approximately one-half as long as the secondary stem 60. However, a shorter primary stem could be used in order to increase the proportionate amount of counter-rotational torque, while a longer primary stem could be used in order to decrease the proportionate amount of counter-rotational torque.

In order to display the amount of rotational torque produced by device 20 the device includes the heretofore identified torque measuring means 26. This means measures and indicates the amount of torque which is applied to the nut by the rotational means 22, when a rotary force is applied to the handle 25. Thus, the torque measuring means 26 (FIG. 1) basically includes a measuring or indicator plate 141 and an associated elongated pointer 142. The pointer 142 extends radially outwardly from the lower shell 50, from a point located generally above where the arm 46 joins the working end 29. The pointer 142 is circumferentially offset at a slight angle from the arm 46, when the arm is in a resting state (e.g., no torque is being applied in the rotational direction). As a result, the free end or tip 143 of the rod is situated slightly offset from the stem 58 so that it is not obstructed from view by the stem but is readily visible to the operator of the device under most operating conditions.

The measuring plate 141 is a generally planar, rectangular member which contains marker indicia and associated numbers 144 on its planar face to indicate the amount of torque being applied to the nut by the rotational means. It should be stated that the numbers and indicia 144 appearing on the measuring plate, as shown in the various Figs. of the drawing are merely exemplary of indicia and numbers actually used in a commercial embodiment of the device.

The measuring plate 141 is mounted to the top surface of the arm 46 adjacent the handle means 25, but also slightly off-centered from the axis of the arm. As a result, the tip 143 is centered with respect to indicia on the plate when the arm 46 is in a resting state.

When force is applied to the handle means 25 in either rotational direction, a slight bending of the arm 46 results, with the amount of bending corresponding to the amount of torque being applied to the nut. Since the tip 143 of the rod is not mounted on the arm 46 but is mounted on the shell 50, the tip remains generally stationary relative to the shell 50 as the measuring plate moves thereunder along with the arm 46 as the arm bends. If no rotational torque is applied, i.e., the arm does not bend, the non-bending rotational movement of the arm results in an equal amount of rotational displacement of the pointer, so that the pointer remains at a fixed relative position with respect to the measuring plate.

As mentioned earlier the device 20 also includes a second or counter-rotational torque measuring means 28. Such means is quite similar to the rotational torque measuring means 26. Thus, the counter-rotational torque measuring means 28 includes a pointer 146 which is connected to the upper shell 74 above the secondary stem 60 of the counter-rotational means. The pointer 146 is mounted parallel with the secondary stem 60 (when no counter-rotational torque is being applied) and extends to the point where its free end or tip 148 is adjacent the secondary gear 66. A counter-rotational torque measuring plate 150 is mounted on the stem 60. The plate 150 is nearly identical to the rotational measuring plate 141 except the plate 150 is mounted centered on the secondary arm and therefore, centered with respect to the tip 148, as well (when no torque is being applied to the bolt 38). The plate 150 contains indicia and numbers 152 for measuring and indicating how much counter-rotational torque is being applied to the bolt 38.

As should thus be appreciated, the torque applied to the bolt 38 by the secondary stem 60 causes the secondary stem to bend or deflect slightly in the rotational direction in which the torque is being applied. This results in the measuring plate, which is fixed to the secondary stem, moving in that direction. As a result, the tip 148 of the rod 146 points to indicia 152 to indicate how far the stem 60 has deflected, with the amount of deflection corresponding to the amount of torque being applied to the bolt 38.

Again, the indicia 152 shown in the various Figs. of the drawing is merely exemplary of indicia used in an actual commercial embodiment of the device.

It is frequently desirable, and at times necessary when using the wrench 20, to also use a socket extension in order to reach an otherwise generally inaccessible nut and bolt.

To that end, the socket extension 170 (FIG. 8) is provided to effectively extend the reach of the nut and bolt engagement means 30 and 32, respectively, to a predetermined distance from the device's working end 29, whenever desired. When the extension 170 is used, an interchangable socket 45 (FIG. 4) is attached to the free end of the extension, instead of being attached directly to the device's working end 29.

As can be seen in FIG. 8 the socket extension 170 is an elongated, generally hollow cylindrical member having a upper end 172 and a lower or free end 174. The upper end 172 is arranged to be readily connected to or removed from, the nut and bolt engagement means, 30 and 32, respectively, as desired. The extension 170 is in the form of a generally cylindrical shell 176 having an axially elongated passageway 178 extending the entire length of the extension. The free end 174 is arranged to readily connecte to interchangable sockets of the same type and in the same manner as the type and manner otherwise used with the nut and bolt engagement means 30 and 32, respectively, when the extension 170 is not being used. Thus, the free end 174 of the shell 176 is of reduced, square cross-sectional construction and of appropriate size to be inserted within and to releasably engage the mounting hole 97 of the socket 45.

The passageway 178 comprises three contiguous, axially aligned bores, namely an upper bore 180, an intermediate bore 182 and a tubular bore 184. The upper bore 180 is in the form of a square recess of appropriate size to receive and tightly engage the lower shank 95 of the nut engagement means. The intermediate bore 182 is cylindrical. The bore 184 is contiguous to the intermediate bore 182 and extends to an opening 186 in the bottom surface of the shell 176.

A rod 190 which is coupled to the bolt engagement means 32 is located within the passageway 178. The rod 190 includes a circular head 192 and a hexagonally shaped shank 194. The free end 196 of the shank extends through the opening 186 and is of appropriate size and shape to engage the recess 42 (FIG. 4) of the bolt 38. It should also be pointed out that the shank 194 is free of contact with the walls of the shell 176 so as to be able to rotate and otherwise move within the passageway 184, independently of the movement of the shell 176.

The head 192 is integrally formed at the top end of the rod 190 and is of larger diameter than the shank 194. Furthermore, the head 192 is located within the intermediate bore 182 and is precluded from moving outside the intermediate bore 182 due to its enlarged size.

Still further, the head 192 includes an axially disposed, hexagonally shaped recess 194 of appropriate size to receive and engage the free end of the rod 120.

The rod 194 is biased downwardly into engagement with the bolt 38 by a compression spring 196. One end of the spring 196 presses against the head 192 of the rod while its other end abuts a retaining ring 194. The retaining ring 194 is secured within an annular recess 196 in the wall of the shell 196, adjacent the interface between the upper and intermediate bores 180 and 182, respectively, of the passageway.

In view of the foregoing discussion, it should readily be appreciated that the shank 95 of the nut engagement means is inserted within and engages the upper portion 180 of the socket extension 170, while the free end 120 of the bolt engagement means extends through the upper portion 180, along the hollow central axis of the spring 196 and into the notch 194, for engagement thereto.

Consequently, rotational movement of the nut engagement means 30 causes the outer shell 176 to rotate in a corresponding first rotational direction, while the rotatioanal movement of the bolt engagement means 32 in the opposite rotational direction, causes the rod 190 to also rotate in that direction, independently of the rotational movement of the shell 176. As a result, when the free end 196 of the rod is inserted into the bolt's recess 42 and the free end of the shell 177 is inserted into the socket 45, the ratchet extension 170 is readily used in combination with the device 20 to rotate a nut in a first rotational direction while at the same time counter-rotating its associated bolt in the opposite rotational direction.

As will be appreciated from the foregoing, the device 20 is simple in construction, and can be readily utilized to tighten a nut on a bolt in a manner designed to reduce the amount of stress on the bolt. Moreover, the device includes means to indicate the amount of torque which is being applied to the nut and the bolt, respectively.

Without further elaboration, the foregoing will so fully illustrate my invention that others may, by applying current or future knowledge, readily adapt the same for use under various conditions of service.

I claim:

1. A compensating torque wrench device for rotating an internally threaded member on an externally threaded member in a manner designed to reduce the amount of stress on said externally threaded member adjacent its interface with said internally threaded member, said externally threaded member having a free end including third engagement means, said device comprising a working end including first engagement means for engaging said internally threaded member and second engagement means in the form of a rotatable projection for engaging said third engagement means of said externally threaded member, first and second rotational means and a driven end, wherein said driven end is connected to said first engagement means by said first rotational means and to said second engagement means by said second rotational means in a manner such that force applied to said driven end causes the first rotational means to exert a first predetermined amount of torque on said first engagement means and thus on said internally threaded member, causing them to rotate in a first rotational direction and causes the second rotational means to exert a second predetermined amount of torque on said second engagement means and thus on said externally threaded member, causing them to rotate in the opposite rotational direction.

2. The device of claim 1 wherein said third engagement means comprises a recess in said externally threaded member.

3. The device of claim 2, wherein said projection is a generally rod-like member.

4. The device of claim 3 wherein said generally rod-like member extends through and is rotatable independently of said first engagement means.

5. The device of claim 1, wherein one of said rotational means comprises an elongated arm which produces rotational movement in its associated engagement means in a first rotational direction and the other of said rotational means comprises gear means which produces rotational movement in its associated engagement means in the opposite rotational direction.

6. The device of claim 5 wherein said gear means comprises mating first and second gears, said first gear being connected to said driven end and said second gear being connected to said second rotatational means.

7. The device of claim 1, wherein said driven end includes handle means which is pivotably connected to one of said rotational means and immovably connected to the other of said rotational means.

8. The device of claim 7, wherein said handle means comprises a pivot rod and one of said rotational means comprises a bore, with said pivot rod extending through said bore to connect said handle means to the other of said rotational means.

9. The device of claim 1, wherein said first rotational means is connected to said first engagement means and said second rotational means is connected to said second engagement means by first and second ratcheting means, respectively.

10. The device of claim 1, further comprising first torque measuring means which indicates the amount of torque being applied to one of said members.

11. The device of claim 10, wherein said torque measuring means comprises an elongated pointing member connected to said working end and scale means connected to one of said rotational means.

12. The device of claim 11, wherein said scale means comprises a generally planar member having indicia thereon.

13. The device of claim 12, further comprising second torque measuring means which includes a second pointing member, wherein said first and said second torque measuring means are coupled to said first and to said second engagement means, respectively.

14. The device of claim 1, wherein said handle means includes an elongated stem and gripping means, with the length of said stem being readily changed as desired.

15. The device of claim 14, wherein the length of said stem is changed by using interchangeable stems of varying lengths.

16. The device of claim 1, wherein said first engagement means comprises nut engagement means and said second engagement means comprises bolt engagement means.

17. The device of claim 16, wherein said nut engagement means comprises a socket member and said bolt engagement means comprises a rod-like member of polygonal cross-section.

18. The device of claim 1, further comprising means for biasing said projection into engagement with said third engagement means.

19. The device of claim 18, wherein said biasing means comprises a spring.

20. The device of claim 1, further comprising an extension member which includes elongated means for coupling said first engagement means and said second engagement means to the respective threaded members.

21. A compensating torque wrench device used for tightening an internally threaded member to an externally threaded member in a manner designed to reduce the amount of stress on said externally threaded member adjacent its interface with said internally threaded member, wherein said device comprises a working end including first and second engagement means for engaging said internally threaded and said externally threaded members, respectively, a driven end, first and second rotational means and first torque measuring means coupled to one of said rotational means, said driven end being connected to said first engagement means by said first rotational means and to said second engagement means by said second rotational means in a manner such that force applied to said driven end causes the first rotational means to exert a first predetermined amount of torque on said first engagement means, causing it to rotate in a first rotational direction and causes the second rotational means to exert a second predetermined amount of torque on said second engagement means, causing it to rotate in the opposite rotational direction, such that when said first and said second engagement means are coupled to said internally threaded and said externally threaded members, respectively, said internally threaded member is tightened to said externally threaded member in a manner tending to minimize the amount of stress on said externally threaded member adjacent its interface with said internally threaded member and said torque measuring means indicates the amount of torque being applied by one of said rotational means to its corresponding member.

22. The device of claim 21, wherein said torque measuring means comprises an elongated pointing member connected to said working end and scale means connected to one of said rotational means.

23. The device of claim 22, wherein said scale means comprises a generally planar member having indicia thereon.

24. The device of claim 23, further comprising second torque measuring means comprising a second elongated pointing member, wherein said first and said second torque measuring means are coupled to said first and to said second engagement means, respectively.

* * * * *